US007383881B2

(12) United States Patent
Telfer

(10) Patent No.: US 7,383,881 B2
(45) Date of Patent: Jun. 10, 2008

(54) STABILISER, JETTING AND CIRCULATING TOOL

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 231 days.

(21) Appl. No.: 10/509,714

(22) PCT Filed: Apr. 3, 2003

(86) PCT No.: PCT/GB03/01432

§ 371 (c)(1),
(2), (4) Date: Jun. 6, 2005

(87) PCT Pub. No.: WO03/087526

PCT Pub. Date: Oct. 23, 2003

(65) Prior Publication Data

US 2006/0219441 A1 Oct. 5, 2006

(30) Foreign Application Priority Data

Apr. 5, 2002 (GB) ..... 0207851.7

(51) Int. Cl.
*E21B 23/12* (2006.01)

(52) U.S. Cl. ..... 166/212; 166/222; 166/312; 175/324; 175/323

(58) Field of Classification Search ..... 166/212, 166/381, 312, 222; 175/61, 325.1, 323, 324
See application file for complete search history.

(56) References Cited

U.S. PATENT DOCUMENTS

| | | | | |
|---|---|---|---|---|
| 3,371,729 | A * | 3/1968 | Carr | 175/293 |
| 3,642,079 | A | 2/1972 | Van Note | |
| 4,825,947 | A | 5/1989 | Mikolajczyk | |
| 5,265,684 | A * | 11/1993 | Rosenhauch | 175/61 |
| 5,911,285 | A | 6/1999 | Stewart et al. | |
| 6,189,618 | B1 * | 2/2001 | Beeman et al. | 166/312 |
| 6,474,423 | B1 * | 11/2002 | Wood | 175/323 |

FOREIGN PATENT DOCUMENTS

| | | |
|---|---|---|
| GB | 2272923 | 6/1994 |
| GB | 2361019 | 10/2001 |

* cited by examiner

*Primary Examiner*—David J. Bagnell
*Assistant Examiner*—Brad Harcourt
(74) *Attorney, Agent, or Firm*—Osha Liang, LLP

(57) ABSTRACT

A downhole tool (10) for use in oil and/or gas well bores. The tool has a tubular body (20) and a sleeve (22) including stabilizer blades (30). The tool is ball (76), activated, weight activated or hydraulically activated to selectively jet fluid from the body through jetting ports (44A, 44B, 44C) on the blades. Thus the tool provides the features of a stabilizer, cleaning tool and circulation tool in-one.

11 Claims, 3 Drawing Sheets

STABILISER, JETTING AND CIRCULATING TOOL

This patent application claims an international filing date of 3 Apr. 2003 and a priority date of 5 Apr. 2002. The present invention relates to downhole tools used in oil and gas wells and in particular to a downhole tool which provides the combined functions of stabilizing, jetting fluid and circulating fluid within the well bore.

In drilling or completing a well bore, it has been recognized that significant time and cost savings can be made if a number of tools providing different functions can be mounted on the same work string and run together into the well bore. Each tool mounted on the work string must be capable of being operated independently. A large number of methods of operating tools on a work string have been developed and they typically include ball activated, weight activated or hydraulically activated tools.

However there are disadvantages in providing so many tools on a work string. The location of each tool within the well bore must be considered so that the string requires minimal repositioning and reciprocation in the well bore to operate each tool. Additionally the time and requirements in making up the string prior to the run must be carefully considered as the string can have an excessive working length.

It would therefore be advantageous to provide a downhole tool for use on a work string which can provide a plurality of functions within the well bore and therefore reduce the number of tools which require to be mounted on a work string.

It is an object of the present invention to provide a downhole tool which can operate in a number of functional modes simultaneously within a well bore.

It is a further object of at least one embodiment of the present invention to provide a downhole tool which performs the functions of stabilising, jetting and circulating fluid simultaneously within a well bore.

It is a further object of at least one embodiment of the present invention to provide a downhole tool in which one or more functions can be selectively performed from a selection of functions on the tool.

According to a first aspect of the present invention there is provided a downhole tool for use in a well bore, the tool comprising:

- a tubular body having an axial throughbore and adapted for connection within a work string;
- a sleeve mounted around the body, the sleeve including one or more stabiliser blades, said stabiliser blades including one more jetting ports to direct fluid from the axial throughbore onto a surface of the well bore; and
- one or more actuating means to selectively direct the fluid through the jetting ports and thereby circulate the fluid.

Thus, the downhole tool of the present invention provides a stabilising function, a jetting function for cleaning and a fluid circulating function within a well bore. It will be appreciated that the term well bore covers tubulars such as a casing or liner located in the bore.

Preferably, the one or more actuating means provides a cyclic function. That is the one or more actuating means can be operated to provide at least one cycle wherein each cycle is an on/off/on or alternatively an off/on/off function with respect to the exit of fluid through the jetting ports.

In a preferred embodiment of the present invention, the actuating means provides two cycles.

Preferably also, the actuating means is selected from a group comprising ball activated, weight activated and hydraulically activated or a combination thereof.

Preferably, the sleeve is threaded onto the body. More preferably, the thread is a left-hand thread and thus advantageously the sleeve will tighten while rotating. Preferably, also, the outer diameter of the stabiliser blades on the sleeve are sized to be close to the inner diameter of the tubular in use. Thus, a large outer diameter of the tool provided at the stabiliser blades will improve the jetting effectiveness. Preferably, the stabiliser blades are arranged in a helical pattern around the sleeve. More preferably, there is a triangular flow-by groove between adjacent stabiliser blades. Such triangular flow-by grooves minimise cutting action on the surface of the well bore.

Preferably, the/each stabiliser blade has a central portion including a surface parallel to the axial throughbore. Advantageously, the one or more jetting ports are arranged on the parallel surface of the stabiliser blades. Thus, the jetting ports are arranged at the closest position to the surface of the well bore.

Preferably also the blades include a milling surface. Preferably, the milling surface is at a leading end of the work string. Advantageously, the milling surface is of tungsten carbide to provide a reaming or cutting function and assist the tool in clearing obstacles and/or removing debris from the surface of the well bore.

The jetting ports may be arranged substantially perpendicular to the axial throughbore. More preferably, one or more jetting ports are arranged at an angle to the perpendicular to provide a larger cleaning surface against the surface of the well bore when the fluid is jetted.

Advantageously, each jetting port includes a nozzle. The nozzle may be located at an exit of the jetting port. The nozzles reduce the diameter available for fluid flow and thereby increase the velocity of the flow as it exits the tool. Advantageously, each nozzle is located below the outer surface of the sleeve. This provides an advantage in allowing wear of the tool to occur without obstructing the nozzle so that the nozzles may be removed and installed easily.

Preferably, a channel is located between the body and the sleeve. Preferably, also, the jetting ports access the channel. Advantageously, the one or more actuating means direct fluid from the axial throughbore to the channel prior to the fluid flowing through the jetting ports. Thus, as the same jetting ports are used, each time the actuating means operates, this minimises the potential for leaks within the tool.

Embodiments of the present invention will now be described, by way of example only, with reference to the following Figures in which.

Figure 1:
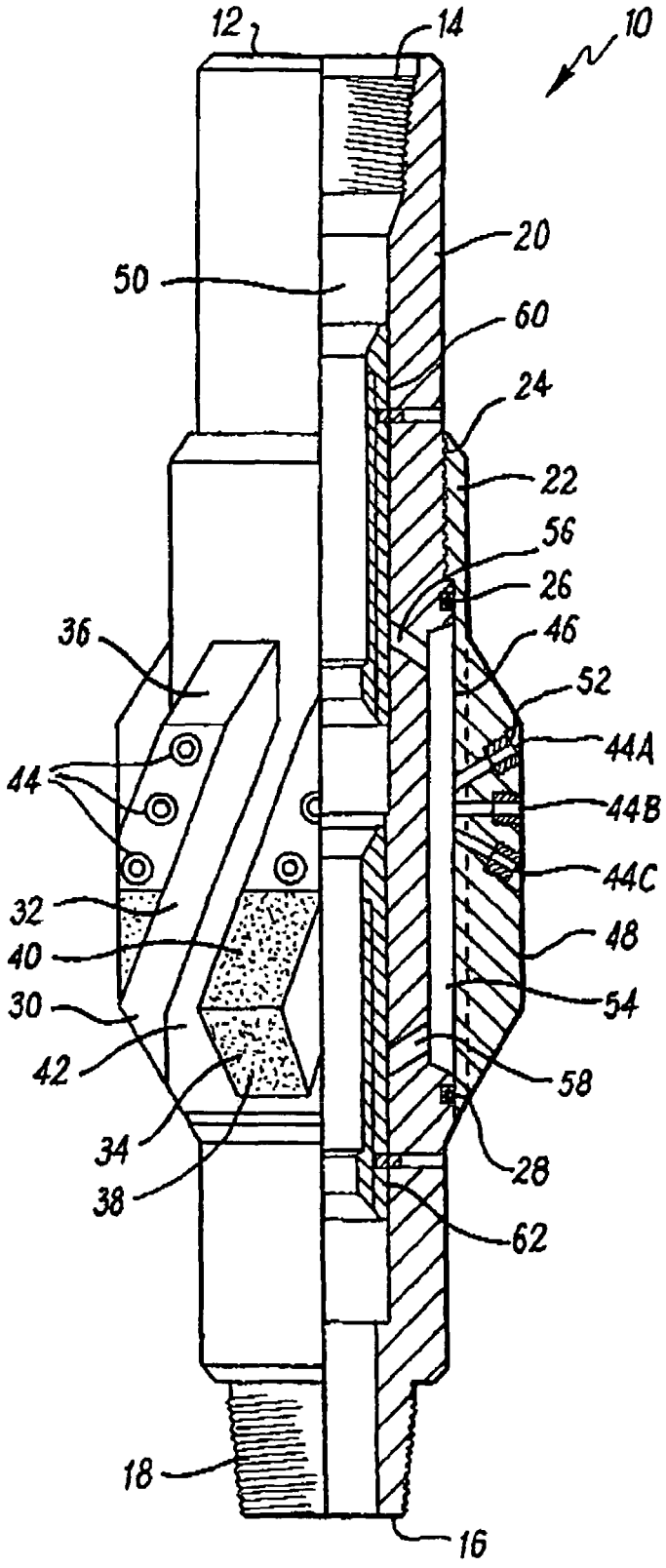
FIG. 1 is a part cross-sectional schematic view of a downhole tool according to a preferred embodiment of the present invention.

Reference is initially made to FIG. 1 of the drawings, which illustrates a downhole tool generally indicated by Reference Numeral 10, according to a preferred embodiment of the present invention. Tool 10 has an upper end, including a box section 14 for connection in a work string (not shown). Tool 10 also has a lower end 16, which includes a pin section 18 for connection in a work string mounted below the tool 10. It will be appreciated that although references to upper and lower are provided it will be understood by those skilled in the art that the downhole tool of the present invention could be used in a vertical, inclined or a horizontal position in a well bore. It will further be appreciated that the tool of the present invention has application within a well bore during a drilling operation or in a cased or lined well bore where a tubular has been inserted during completion.

Tool 10 comprises a tubular body 20. A sleeve 22, is mounted around the body 20, and is held in place by a threaded connection 24. The thread is left-handed so that when the tool is rotated the sleeve 22 will be tightened onto the body 20. O-rings 26, 28 are located between the body 20 and the sleeve 22, to prevent the ingress of dirt or the outflow of pressure between body 20 and the sleeve 22.

Mounted on sleeve 22 are a number of blades 30. Blades 30 are arranged in a helical or spiral pattern on the sleeve 22. Each blade has a longitudinal body 32 with a sloping front face 34 and a sloping back face 36. The front face 34 has a hardened surface 38, which partly extends onto a planar surface 40 between the sloping faces 34, 36. The hardened surface 38 allows the blades 30 to contact debris or other obstacles within the well bore and mill them or clean them off.

Between the blades 30 are located channels 42. The channels 42 have a triangular cross-section and act as flow-by grooves between the blades to minimise cutting action of the blades on the formation in the well bore. Located on the planar section 40 of each blade are three jetting ports 44A, B and C. Each port 44 A, B and C provides access between a back surface 46 of the sleeve 22 and a front surface 48 of the sleeve 22.

The inlet ports 44A, B and C are arranged so that the central port 44B is perpendicular to a central bore 50 which runs through the body 20 while the ports 44A and C are angled with respect to port 44B. Each port 44 includes a nozzle 52, which reduces the diameter of the port 44 and thereby increases the speed of fluid passing through the port 44. Each port 44, contacts a channel 54, located between the body 20 and the sleeve 22. This channel houses fluid and the o-rings 26, 28 prevent the fluid from escaping from the tool 10 by means other than those provided at ports 44.

Within the body 20 there are located two inlet ports, 56, 58. Each inlet port 56, 58 is associated with an actuating means 60, 62. The actuating means 60, 62 are primarily located within the central bore 50. The actuating means 60, 62 control the passage of fluid within the central bore 50, through the ports 56, 58 respectively and into channel 54. This controls the passage of fluid out of the tool via the inlet ports 44. It will be appreciated that although only one inlet port 56, 58 is associated with each actuating means 60, 62 there may be any number of inlet ports 56, 58 and equally any number of actuating means 60, 62 as long as the fluid from each is located within the channel 54.

Figure 2A:
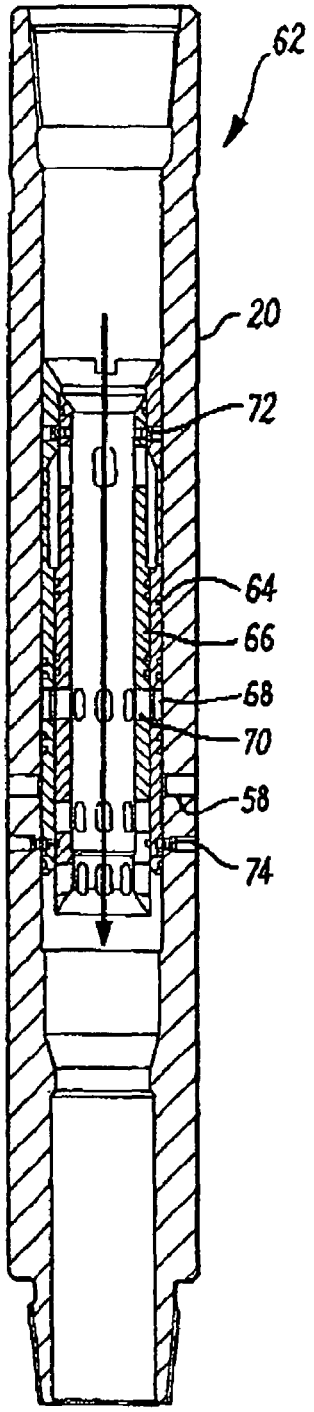
FIG. 2 is a cross-sectional schematic view of the actuating means used in the tool of FIG. 1. Figures (a), (b) and (c) illustrate the actuating positions of the tool.
Figure 2B:
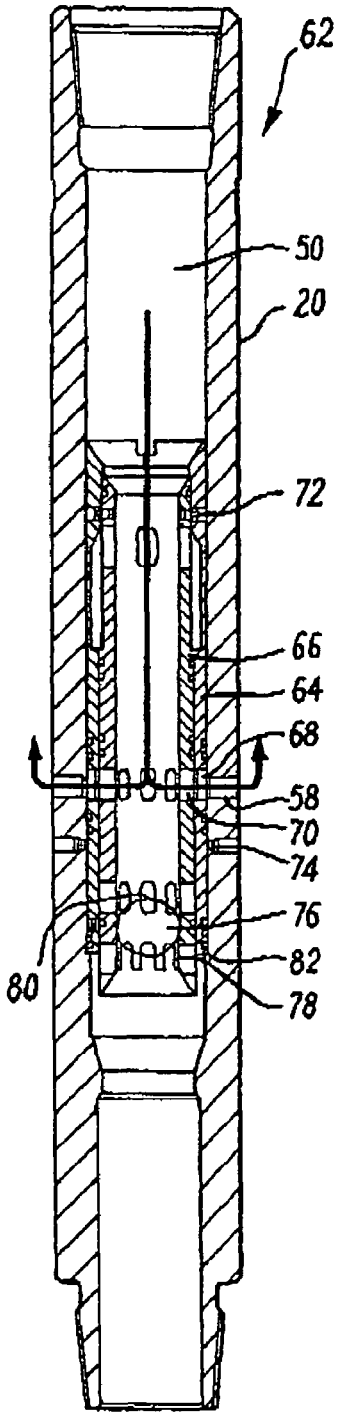
Figure 2C:
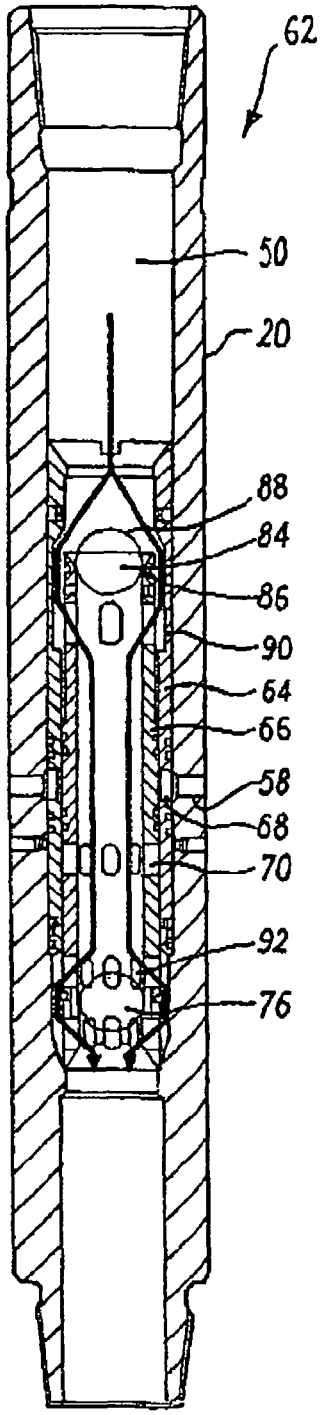

Reference is now made to FIG. 2 of the drawings which illustrate an actuating means, generally indicated by Reference Numeral 62, as would be found in the tool of FIG. 1. Like parts to those of FIG. 1 have been given the same Reference Numerals to aid interpretation. The actuating means 62 is a drop ball actuating means as would typically be found in a downhole tool. An example of such a downhole tool would be U.S. Pat. No. 6,253,861 to Specialised Petroleum Services Group Limited, the present Applicant. U.S. Pat. No. 6,253,861 is hereby incorporated by reference.

Actuating means 62 comprises first 64 and second 66 sleeves arranged concentrically within the body 20. Each sleeve, 64, 66 includes a respective port 68, 70. The ports 68, 70 provide access through the sleeves 64,66. It will be appreciated that each port 68, 70 generally comprises a plurality of ports circumferentially arranged on the sleeve 64, 66. As shown in FIG. (a) the sleeves are initially arranged side by side and held together via a shear pin 72. Further, the pair of sleeves 64,66 are held to the body by means of a second shear pin 74. Shear pin 74 is located through the body 20 and into the first sleeve 64.

In use, the tool 10 is run into the well bore or tubular. The diameter of the tool 10 at the blades 30 would be selected to provide a small clearance between the tool and the surface of the well bore or tubular. A typical clearance may be a number of millimeters.

Once located at the point where fluid is required to be jetted or circulated a drop ball 76 is inserted into the central bore 50 to travel through the body and locate in a ball seat 78 of the second sleeve 66. Ball 76 blocks the axial passage of fluid through the bore 50 and as a result pressure will build up on an upper surface 80 of the ball 76. The increase in pressure will shear the pin 74 and allow the sleeves 66, 64 to move axially through the bore 50. The sleeves 64, 66 will move together by virtue of the shear pin 72. The sleeves 64, 66 travel to a stop 82. At the stop 82 the sleeve 64 and 66 are positioned such that the ports 68 and 70 align with the port 58 and thereby allow fluid in the bore 50 to enter a channel 54 and exit the jetting ports 44.

Once the jetting and circulation requirement is complete the tool 10 can be closed as shown in FIG. 2(*c*) by virtue of a second drop ball 84 being inserted through the bore 50. Ball 84 is a larger diameter than ball 76 and locates on a ball seat 86 on the second sleeve 66. Ball 84 prevents the passage of fluid through the bore 50 and thereby pressure increases on its upper surface 88 until the shear pin 72 shears and the sleeves 64 and 66 disengage from each other. On disengagement the innermost sleeve 66 will fall relative to the outer sleeve 64. The innermost sleeve falls a distance to a second stop. In this position a by-pass channel 90 in the first sleeve 64 provides a passage of fluid around the drop ball 84. Similarly, at drop ball 76 a by-pass passage towards the body 20 is now accessed from ports 92 in the sleeve 66.

Thus, in the closed position the port 70 of the inner sleeve 68 is now misaligned with the port 66 of the outer sleeve 64 and the port 58 leading to the channel 54. By the insertion of two drop balls, the tool has performed one cyclic function in taking the jets 44 from a closed position to an open position and again to a closed position.

Referring back to FIG. 1, it will be seen that a similar actuating means as shown in FIG. 2 can be located at position 60 and through port 56. A second cyclic motion can be performed. In this regard, a twin cycle is possible with tool 10 and thus by timed insertions of drop balls of sufficient diameter the jetting ports 44 can function in a selective on or off position.

As will be appreciated by those skilled in the art the actuator means 60, 62 in FIG. 1 may be replaced by any actuator means which causes selective opening and closing of a channel 56, 58 into the channel 54 to give access to the ports 44.

Figure 3:
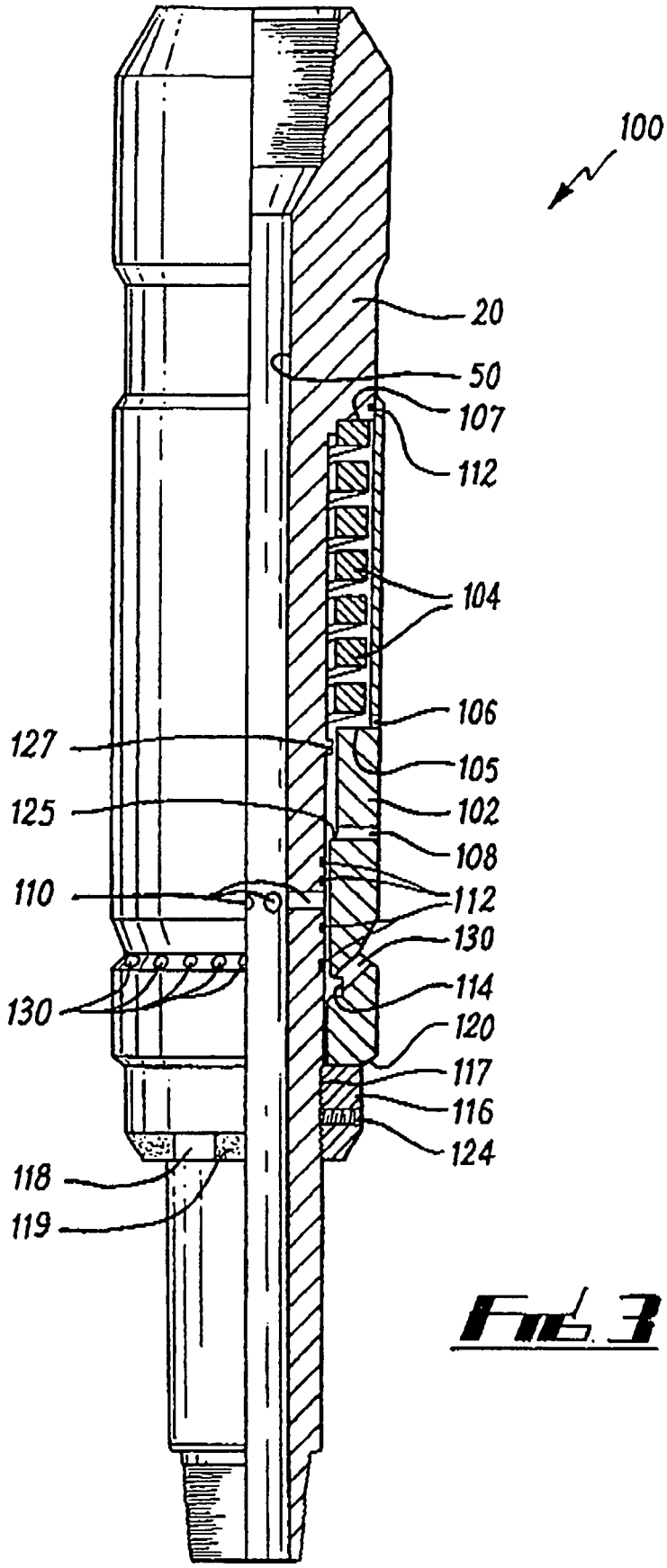
FIG. 3 shows an alternative actuating means, which may be used in the downhole tool of the present invention.

Reference is now made to FIG. 3 of the drawings which illustrates a portion of a circulation tool generally indicated by Reference Numeral 100 which could be used as the actuating means 60, 62 of a downhole tool of the present invention. Like parts to those of FIG. 1 have been given the same Reference Numeral. As with FIG. 1, the actuator means 100 is positioned on the body 20 which has a central bore 50. The actuator means comprises a sleeve 102 located on the body 20 which is biased against the body by means of a helical spring 104 housed between ledges 105, 107 on the sleeve 102 and body 20 respectively. Located in the sleeve 102 are two vent holes 106, 108, which permit the equalisation of pressure outside the sleeve 102 with pressures between the sleeve 102 and the body 20. Located in the sleeve 102 are a plurality of ports 130. Also mounted on the body 20 are five O-ring seals 112, which sealingly engage with the sleeve 102. On the inside of the sleeve 102 adjacent to circulating ports 110 is an internal groove 114 found on the inner surface of the sleeve 102.

Below the sleeve 102 is a spring tensioner ring 116 which is threadably engaged to the body 20 through a thread formation 117. A set screw 124 is provided to lock the spring tensioner 116 in position on the body 20.

The spring tensioner 116 has a single shoulder 118 to which hard facing in the form of tungsten carbide 119 is applied. At the lower end of the sleeve 102 adjacent to spring tensioner ring 116, an actuating shoulder 120 is provided.

The actuating means 100 is moved by virtue of the shoulder 120 contacting a formation in the well bore. This formation may be the upper edge of a liner or polished bore receptacle. Initially when the shoulder 120 contacts the formation, the tool remains in the position shown in the Figure. In this position the ports 110 are obturated by the sleeve 112 and fluid can be pumped through the bore 50. Weight can then be set down upon the tool 10, this weight causes the body 20 to drop relative to the sleeve 102 and the helical spring 104 will be compressed. Travel of the sleeve 102 is limited by a shoulder 125 contacting a surface 127 formed as a lock on the body 20. This helps prevent the spring 104 becoming spring bound. When the shoulder 125 abuts against the lock 127 the groove 114 is adjacent to the ports 110 and the ports 110 in the body 20 communicate with the ports 130 on the sleeve 102. It will be appreciated that ports 130 are equivalent to the ports 56, 58 of FIG. 1 and thus fluid from the bore 50 again can pass into channel 54. To close the ports 130 weight is lifted off the tool and the spring 104 biases the sleeve 102 to return to the position shown in FIG. 3.

A principal advantage of the present invention is that it combines a number of functions on a single tool within a well bore. A further advantage of the present invention is that it can provide an increased annulus velocity for hole cleaning due to the small clearance provided between the ports 44 and the inner surface of the well bore or tubular in use.

It will be appreciated by those skilled in the art that this tool can replace a conventional stabiliser used in a bottom hole assembly. Further, drilling can be performed with this tool mounted in the bottom hole assembly and the tool can be also used to pump mud while drilling. Alternatively, the tool can be used to jet clean the low pressure housing, the high pressure well head and downhole casing adapter profile, as it is more effective than using the bit and does not require an extra trip into the well. The tool can further be run in conjunction with a mud motor and can be used to shut down the bit at the shoe to minimise casing wear while pumping. It will also be appreciated that the tool may be run in conjunction with an under reamer and can be used to deactivate blades at a shoe. Thus it can be used in preference to dropping a dart.

Advantageously the present invention provides a large outer diameter jetting and circulating device that acts as a drilling stabiliser as well and can be activated by different means one or more times. Thus, specific areas within the well can be jetted at various times without retrieval of the string from the well.

Various modifications may be made to the invention herein described without departing from the scope thereof. Primarily it will be appreciated that any actuating means which provides selective opening and closing of a channel in the body of the tool may be incorporated as one or more of the actuating means in the tool of the present invention.

The invention claimed is:

1. A downhole tool for use in a well bore, the tool comprising:

a tubular body having an axial throughbore and adapted for connection within a work string;

a sleeve mounted around the body, the sleeve including one or more stabiliser blades, said stabiliser blades including one or more jetting ports to direct fluid from the axial throughbore onto a surface of the well bore;

one or more actuating means to selectively direct the fluid through the jetting ports and thereby circulate the fluid;

and wherein a channel is located between the body and sleeve, accessed by the jetting ports.

2. A downhole tool as claimed in claim 1 wherein the one or more actuating means provides a cyclic on/off function.

3. A downhole tool as claimed in claim 1 wherein the actuating means is selected from the group consisting of ball activated, weight activated and hydraulically activated actuating means or a combination thereof.

4. A downhole tool as claimed in claim 1 wherein an outer diameter of the stabiliser blades on the sleeve are sized to be close to the inner diameter of the tubular in use.

5. A downhole tool as claimed in claim 1 wherein the stabiliser blades are arranged in a helical pattern around the sleeve.

6. A downhole tool as claimed in claim 1 wherein the tool includes a triangular flow-by groove, between adjacent stabiliser blades.

7. A downhole tool as claimed in claim 1 wherein each stabiliser blade has a central portion including a surface parallel to the axial throughbore, on which are arranged the one or more jetting ports.

8. A downhole tool as claimed in claim 1 wherein the blades include a milling surface.

9. A downhole tool as claimed in claim 1 wherein one or more of the jetting ports include a nozzle, located below an outer surface of the blade.

10. A downhole tool as claimed in claim 1 wherein the one or more actuating means selectively direct fluid from the axial throughbore to the channel.

11. A downhole tool for use in a well bore, the tool comprising:

a tubular body having an axial throughbore and adapted for connection within a work string;

a sleeve mounted around the body, the sleeve including one or more stabiliser blades, said stabiliser blades including one or more jetting ports to direct fluid from the axial throughbore onto a surface of the well bore; and one or more actuating means to selectively direct the fluid through the jetting ports and thereby circulate the fluid;

and wherein the sleeve is threaded onto the body by a left-hand screw thread.

* * * * *